US006006963A

United States Patent [19]

Paine

[11] Patent Number: 6,006,963

[45] Date of Patent: Dec. 28, 1999

[54] VENETIAN BLIND TIE RACK

[76] Inventor: John W. Paine, 36 Sunset Rd., Wellesley, Mass. 02181

[21] Appl. No.: 08/619,098

[22] Filed: Mar. 20, 1996

Related U.S. Application Data

[63] Continuation of application No. 08/293,507, Aug. 22, 1994, abandoned.

[51] Int. Cl.[6] ..... A47G 25/14

[52] U.S. Cl. ..... 223/85; 223/84; 223/DIG. 1

[58] Field of Search ..... 223/98, 84, 87, 223/DIG. 1, 85; 211/113, 118, 60.1, 70.6; 224/904, 223, 251; 206/292, 294, 296, 298; 383/38, 39; D6/315

[56] References Cited

U.S. PATENT DOCUMENTS

| | | | |
|---|---|---|---|
| D. 168,545 | 1/1953 | Huch | D6/315 |
| D. 197,146 | 12/1963 | Fisher | D6/315 |
| D. 254,644 | 4/1980 | Abramowitz . | |
| D. 259,164 | 5/1981 | Abramowitz . | |
| D. 339,979 | 10/1993 | Wehrley | D6/315 |
| 1,526,122 | 2/1925 | Dau | 383/39 |
| 2,488,973 | 11/1949 | Hall | 211/113 |
| 3,762,570 | 10/1973 | Tobin . | |
| 3,783,995 | 1/1974 | Tobin . | |
| 3,790,045 | 2/1974 | Rigel . | |
| 3,945,500 | 3/1976 | Meckstroth . | |
| 3,967,766 | 7/1976 | Hart . | |
| 3,993,205 | 11/1976 | Pilchard . | |
| 4,059,191 | 11/1977 | Chaisson . | |
| 4,368,823 | 1/1983 | Beckwith . | |
| 4,474,316 | 10/1984 | Philibert . | |
| 4,593,813 | 6/1986 | Powel . | |
| 4,632,285 | 12/1986 | Dillingham . | |
| 4,632,286 | 12/1986 | Koyama . | |
| 4,632,287 | 12/1986 | Beveleander . | |
| 4,655,375 | 4/1987 | Pazeotopoulos . | |
| 4,765,467 | 8/1988 | Kolton . | |
| 4,863,043 | 9/1989 | Bowen . | |
| 4,947,987 | 8/1990 | Keenan | 383/39 |
| 5,110,019 | 5/1992 | Kolton . | |
| 5,161,720 | 11/1992 | Kolton . | |
| 5,190,377 | 3/1993 | Kelly | 383/39 |
| 5,209,382 | 5/1993 | Chang . | |

*Primary Examiner*—Bibhu Mohanty
*Attorney, Agent, or Firm*—Banner & Witcoff, Ltd.

[57] ABSTRACT

A tie storage system for convenient storage and retrieval of neck ties, and similar articles, is constructed with a center sheet of flexible plastic having a plurality of tongues on its left and right edges. Front and rear pocket sheets of flexible, clear plastic are attached to opposite sides of the center sheets at a plurality of seams defining a plurality of front and rear pockets created by the clear sheet material between the seams. The pockets are open at both ends and each pocket is aligned with a tongue. A neck tie is stored in a pocket by folding it about one end of the tie board and inserting the tie and board into a pocket with the inserted edge of the board being the edge about which the tie is folded. The tie is retrieved by pushing the board from one end to get it partially out of the pocket at the other end by extracting the board and tie from the pocket by grasping and pulling them.

2 Claims, 6 Drawing Sheets

VENETIAN BLIND TIE RACK

This application is a continuation of application Ser. No. 08/293,507 filed Aug. 22, 1994, now abandoned.

FIELD

This invention relates generally to the storage of cloth and like materials and more specifically to method and apparatus for storing and transporting neck ties and like cloth materials and articles.

BACKGROUND

Prior art tie racks typically permit neck ties, i.e., ties of the type worn with men's and women's business clothing, to be hung in a closet, possibly from a clothes hanger, some of which may be visible for selection and retrievable with effort. These tie racks normally include a multitude of hooks of various configurations onto or over which an individual tie is folded to hang vertically packed among other ties. Ties on such racks tend to become tightly packed together so that it is difficult to see individual ties to make a specific selection suited for a given day or event. The free hanging ties stored with prior art devices are susceptible to becoming wrinkled due to being crowded together and falling to the closet floor when adjacent ties are retrieved or stored.

SUMMARY

Accordingly, it is a primary object of the present invention to store ties or other similar cloth articles and materials in a manner to minimize wrinkling and to do so in a manner which permits rapid identification and retrieval of a desired tie from a collection.

Another object of the invention is to store ties in a chain of horizontally oriented pockets that are transparent so that individual ties stored in the pockets can be easily inserted, identified and retrieved.

Yet another object of the invention is a tie storage container system that can be draped from a hanger in a closet and which can be expanded as extra ties are acquired and which can be separated to serve as a container while traveling.

Additional, it is an object to devise a plurality of carriers each of which is capable of supporting and protecting a neck tie while stored in one or more tie storage pockets, coupled together, and while being inserted or retrieved from a tie storage pocket.

These and other objects of the invention are achieved and problems of the prior art are overcome by the disclosed embodiment. A preferred embodiment includes a tie storage device, system, or rack of a single or a plurality of tie storage pockets for storing ties on tie boards used to insert and retrieve ties from individual storage pockets. A tie board, with a tie folded about it, is threaded or inserted into a pocket at one end, for storage, and pulled out from the opposite end of the pocket for retrieval.

The user grips the tie board and the open ends of the folded tie, at one end, and inserts the other end of the board into a pocket. The tie, while folded about the tie board, enters the pocket with the folded end of the tie leading the way. The tie is not wrinkled or otherwise distorted in the insertion process because the tie is folded over the leading edge of the board and griped by the hand of the owner at the trailing edge of the tie board. To remove a tie from a pocket, the board is pushed with the finger from the end at which it was inserted to force the other end, i.e., the folded tie end, out of the pocket far enough so that it can be grasped and pulled all the way out of the pocket.

The tie board protects a tie from being wrinkled, rumpled, or wadded up while it is being handled and while it is stored in a pocket. Once out of the tie storage system, a tie readily separates from the tie board. The pockets are, preferably, transparent so that the user can quickly identify which tie, among many, to wear. The preferred embodiment, further discloses a tie rack having tie storage pockets formed on the two sides of a central divider member for increased tie storage capacity.

THE DRAWINGS

Other objects and features of the invention will be apparent from the reading of the present specification alone and in conjunction with the drawings which are as follows. The drawings are not drawn to scale.

FIG. 1 is a perspective view of the presently preferred tie storage system (showing less than the preferred number of storage pockets).

FIGS. 2*a*–2*c* are schematic drawings depicting three of the steps in the process of folding a tie about a tie board or carrier of the preferred embodiment.

FIG. 3. is a front, plan view of the tie storage system of FIG. 1 which is substantially the same as the rear, plan view of the tie storage system. This figure also includes many of the dimensions of the tie storage system.

FIG. 4. is a side view of the tie storage system of FIG. 1 more clearly identifying the center sheet and the relationship of the tie storage pockets on the front and rear of the center sheet.

FIG. 5 is a side view of another embodiment of a tie storage system depicting only one and one half storage pockets.

FIGS. 6*a* and *b* are schematic drawings of portions of tie storage systems illustrating two different methods of attaching a tie storage system to a clothes hanger.

DETAILED DESCRIPTION

Figure 1:
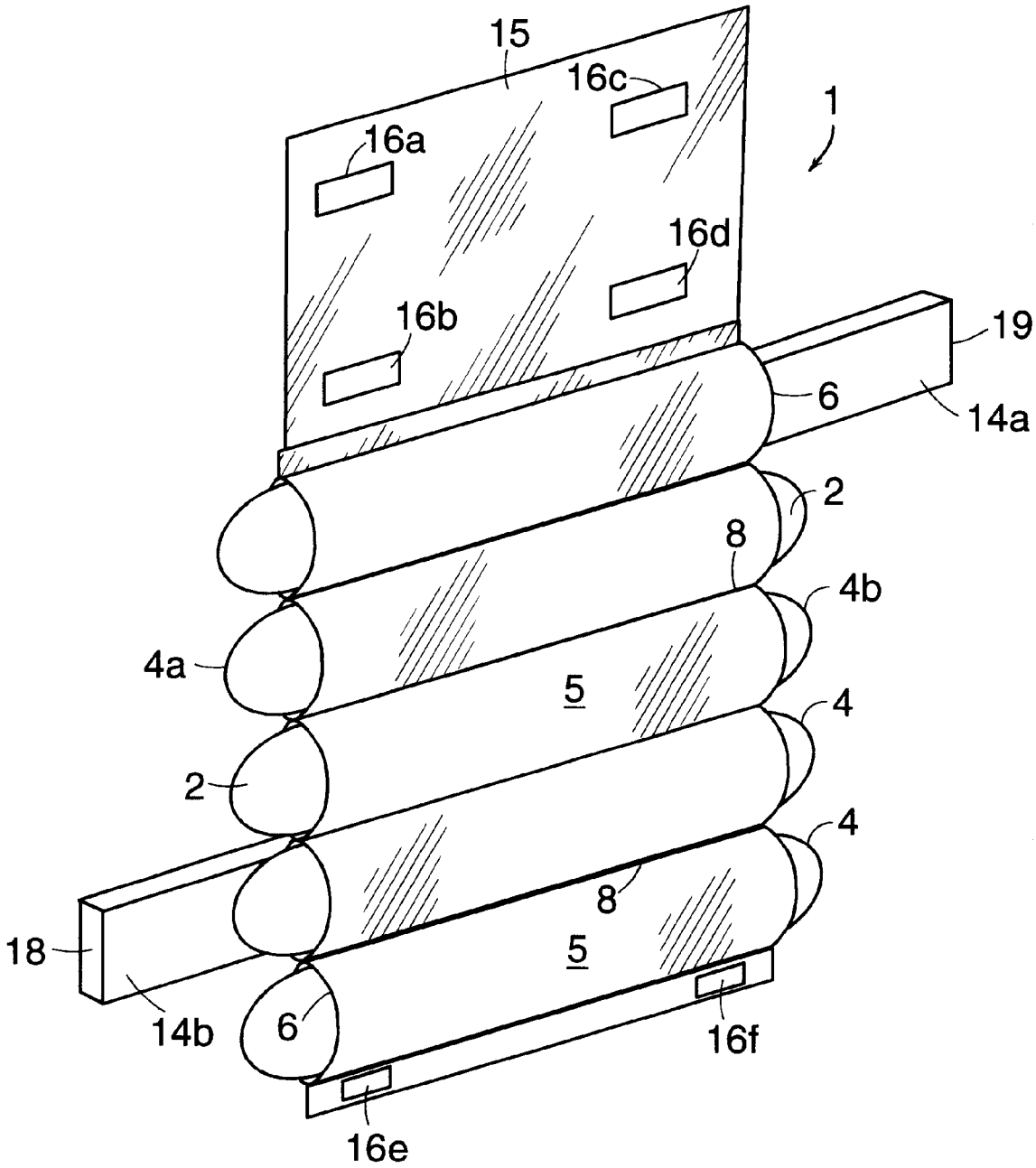

The venetian blind tie storage system 1 of FIG. 1 comprises three sheets of a generally light weight, flexible plastic material. The three sheets are the center, front and back (or rear) sheets. Center sheet 2 has a plurality of tongues 4*a* and *b* along its left and right edges which are useful during the insertion and retrieval of ties. In the preferred embodiment, the center sheet is white (referring to color), although it can be any other color, or a transparent, colorless, plastic. Coupled to the front side of the center sheet 2 is a transparent, continuous plastic sheet 5 from which the parallel, plurality of front pockets 6 are created by means of a plurality of stitched seams 8. (The relationship of the rear sheet to the center sheet is similar to that of the front sheet to the center sheet as discussed below.) Seams 8 are created with thread which is stitched through the center and front sheets to bind them together, or, in the alternative, can be formed, for example, by sealing the center and rear sheets together under the application of heat and pressure. The width of seam 8 is increased when it is formed by heat sealing and when made with two or more rows of stitching. Five, identical, front pockets 6 are shown in FIG. 1 for purpose of illustration only. The presently preferred number of front storage pockets is nine.

Front pockets 6 are constructed by shaping the front sheet 5 into a generally half cylinder when stitched to the center sheet 2. The left and right ends of each storage pocket 6 are open to allow a neck tie to be inserted into or removed from a pocket from either end. The tongues 4*a* and *b,* located at the opposite ends of each pocket 6 are created from center sheet 2 by cutting the left and right edges of the center sheet in the shape of a semi-circle, roughly.

A rear pocket sheet 11 of transparent plastic of identical size as front pocket sheet 5, is coupled to the rear side of center sheet 2. The rear sheet is stitched to the center sheet in the same manner, and, at the same time, that the front sheet is stitched to the center sheet. That is, the rear sheet, in the region between adjacent seams 8, includes adequate material to permit it to be shaped in the general configuration of a half cylinder or rectangle. Consequently, a plurality of rear pockets 12 (shown in FIGS. 4) are available for the storage of ties on the rear side of the storage system. Of course, the front and rear sheets 5 and 11 are much longer than the center sheet, before they are stitched together, due to the material between seams comprising the pockets.

The tie rack of FIG. 1 also includes the tie boards, or carriers 14*a* and *b*. Only two tie boards are explicitly shown in FIG. 1, but it should be understood there are, generally, as many boards as there are pockets. The tie boards are carriers for ties and they fit into pockets along with a tie. Tie board 14*a* is shown being inserted into a front pocket 6 while tie board 14*b* is shown being withdrawn from a rear pocket 12 (see FIG. 4), hidden from view in FIG. 1. Because the pockets 6 and 12 are open at their left and right ends, the tie boards may be inserted into or withdrawn from a pocket from either end. Of course, a tie, similar articles of clothing, such as scarf, other cloth article or cut piece of cloth or cloth like materials are all intended to be folded about the tie board, in a manner described in FIGS. 2*a–c*.

The transparent, front and rear pocket sheets 5 and 11, respectively, are longer at the top than the center sheet 2 and are stitched together, or are otherwise coupled, to form the hanger portion 15 of tie storage system 1. The hanger portion 15 is about 3.5 inches high and about 14.5 inches wide. In an alternative embodiment, not shown, the center sheet is cut generally to the same length of the front and rear sheets (after those sheets are stitched to the center sheet thereby creating the pockets) to add its upper end to the hanger portion 15. The extra layer of stitched sheeting provided by the center sheet mechanically strengthens the hanger portion of the storage system.

Velcro fasteners 16*a–d* are attached to the hanger portion 15 with fasteners 16*a* and 16*b* representing one male/female pair of Velcro fasteners and 16*c* and 16*d* representing another pair. By folding the hanger portion upon itself so that fastener pairs 16*a* and 16*b* and 16*c* and 16*d* mate with each other, the hanger portion 15 is attached to a coat hanger, thus facilitating the storage of the tie rack system in a closet. Other coupling or attachment means can be used in lieu of Velcro fasteners, such as snaps, buttons or zippers. Also, fastener pairs, such as the male and female Velcro fasteners, may be located, generally, near the upper corners of Hanger portion 15. In this case, the tips of the upper corners are folded from the corner toward the center of portion 15, generally, to fasten portion 15 about the left and right shoulders of a hanger. These two embodiments are shown if FIGS. 6*a* and 6*b*.

Figure 2A:
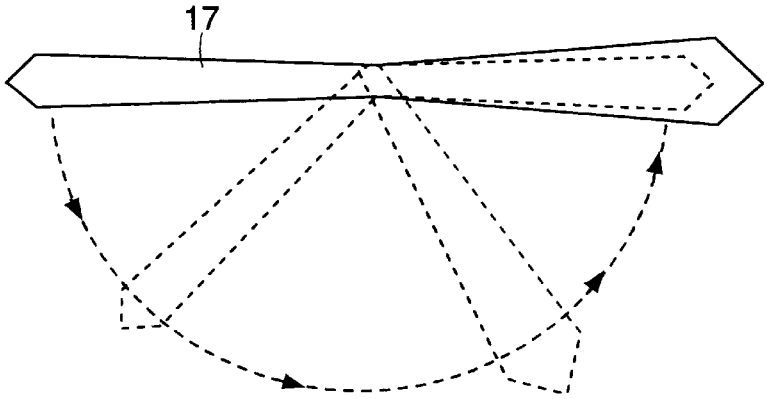
Figure 2B:
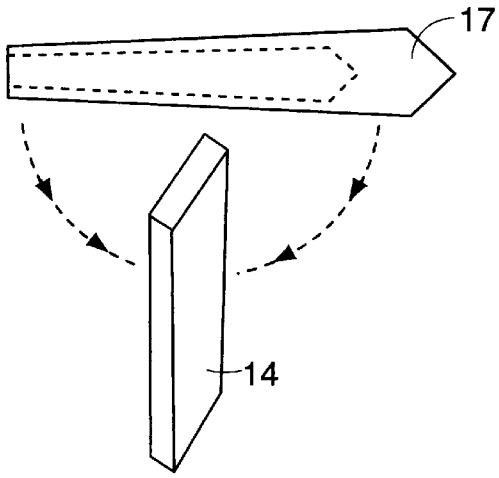

FIGS. 2*a–*2*b* show the presently preferred method of folding a neck tie about a tie board 14. In FIG. 2*a,* a neck tie 17 is depicted being folded, once, about its mid-point. The once folded tie is next folded again about its mid-point as shown in FIG. 2*b*. The edge 18 of the tie board about which the tie is folded, seen in FIG. 2*c,* is referred to as the leading edge of the tie board because it is the end that is first inserted into a pocket and first withdrawn from a pocket. The leading edge of the tie board, for purposes of inserting and retrieving a tie into and out of a pocket, identifies the preferred method of operation of the tie boards with the tie storage pockets.

A tie board is, preferably, removed from a pocket in the same direction in which it is inserted. Following that convention, a neck tie carried by the board is insured of entering a storage pocket without catching, bunching tangling or wrinkling. It is substantially more difficult to insert a tie into a pocket with the trailing edge 19 entering the pocket first, that is, without the use of a fastener, such as a rubber band, or other means to keep the free or tail ends of the ties from catching on the lip of the mouth of a pocket.

Figure 2C:
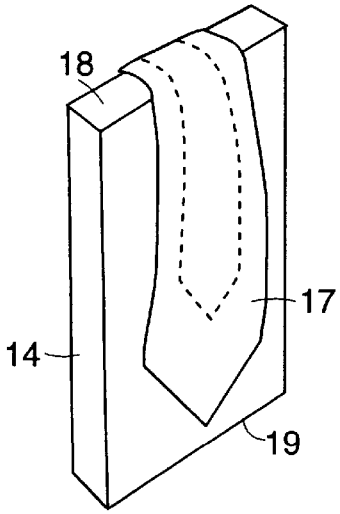

To insert the tie board 14 shown in FIG. 2*c* into a storage pocket 6 or 12, the free ends of the tie near the trailing edge 19 of board 14 are griped between finger and thumb and the leading edge 18 is inserted into a pocket. To remove a neck tie from a pocket, the board 14 is pushed with the finger at the trailing end to force the leading edge, carrying the folded tie end, out of the pocket far enough so that it can be grasped between finger and thumb and pulled all the way out of the pocket. The tie board (with or without a tie about it) can also be retrieved by reaching into a pocket, at either end, grasping the board and pulling the board and tie, if any, out of the pocket.

Figure 3:
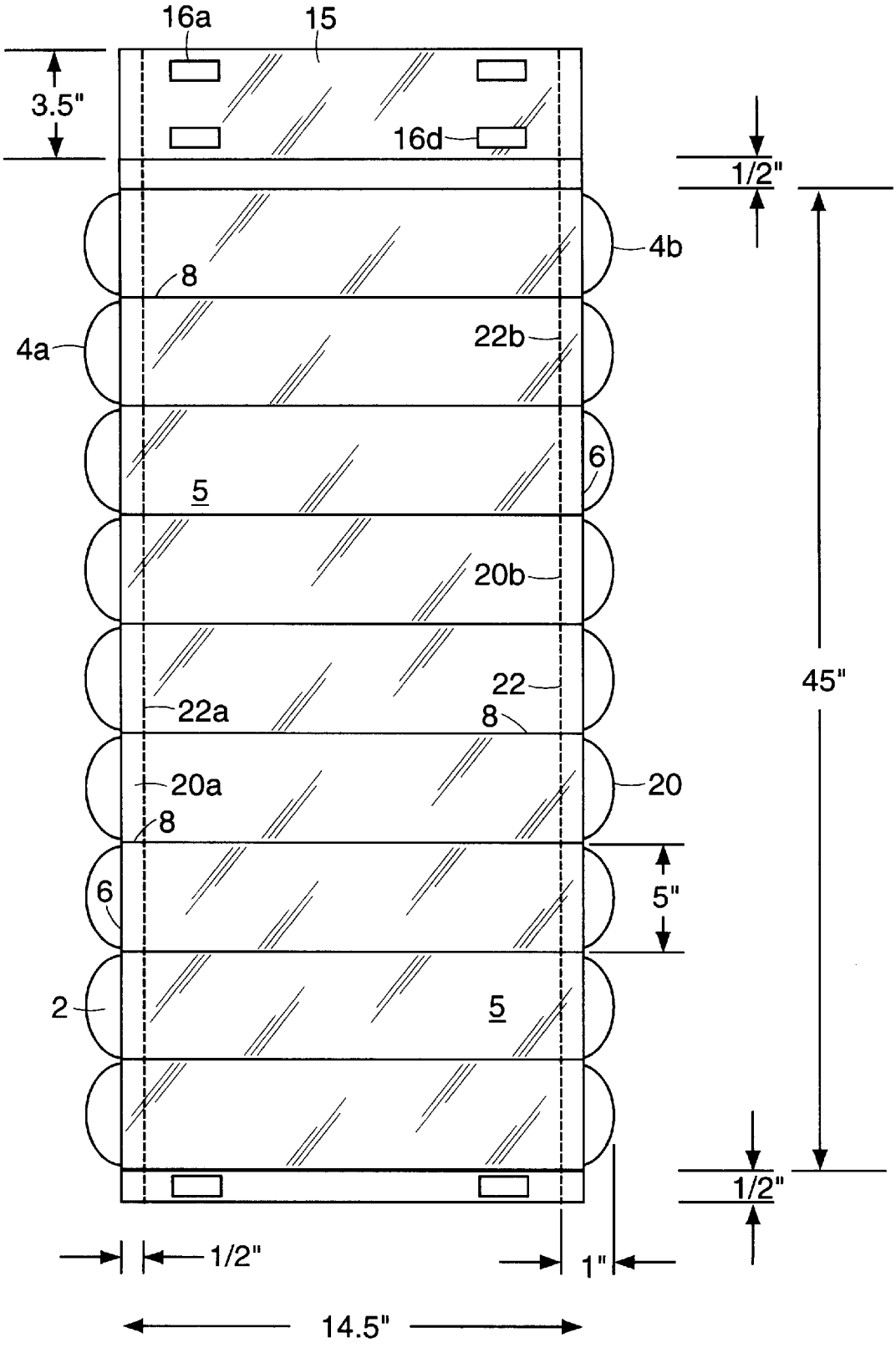

Turning now to FIG. 3, this plan view displays dimensions of the tie storage system 1 and some additional detail of the system. The additional detail shown in FIG. 3 includes the left and right boarders 20 on the front and rear sheets 5 and 11. In the following sentences, references made to the fabrication of the front pockets are, also, applicable to the rear pockets 12. To fabricate the left and right borders 20, the left and right edges of the front sheet are folded about one half inch inwardly from the edge and stitched together with thread to create a double sheet thickness. Thereafter, the front and back sheets 5 and 11 and the center sheet 2 are coupled together by thread at the seams 8. The thread stitching 22 used to fabricate the left and right boarders is shown in FIG. 3.

The borders strengthen the edges of the mouths to the storage pockets to enable them to withstand collisions from a tie board and handling by the user. The folded edges of sheets 5 and 11 are not shown in FIG. 3 because, being folded inward, they are located inside the pockets. When viewing FIG. 3, be aware that the dashed line 22 represents the thread stitching and not the edge of the sheets that were folded to create the boarder. Of course, folding the edges 20 outwardly to be on the outside of the pockets is an acceptable alternative and may be preferred in the event the edge inside a pocket interferes with the insertion or retrieval of a tie board and/or with the neck tie it is carrying. The thickness of the pocket sheets 5 and 11 are about one eighth inch and of the center sheet 2 is about three sixteenth inch.

Referring to the dimensions given in FIG. 3, the center sheet 2 (not counting its left and right side tongues 4) and the front and back sheets 5 and 11 (with their left and right boarders folded to form boards 20) are about 14.5 inches wide. The center sheet is about 46 inches long with about one-half inch at its top and bottom used for stitching the front, rear and center sheets together with thread (not shown). There are nine front pockets shown in FIG. 3 which is the configuration of the preferred embodiment (note—five pockets are shown in FIG. 1 to simply that drawing). The total number of front and rear tie storage pockets of the preferred embodiment is eighteen permitting the storage of that number of neck ties. Of course, the pockets can be sized to accommodate two tie boards or a second tie can be folded over a first, which represent additional, alternative embodiments.

The left and right opening of each of the pockets 6 and 12 are about 5 square inches calculated by multiplying the five inch width of a pocket times a uniform mouth height on one inch above the center sheet 2. The sheets 5 and 11 are pliable permitting the cross-sectional shape of a storage pocket to be varied over a range of shapes encompassing rectangles and semi-circles. The semi-circle cross-section more nearly approximates the cross-section shape of the pockets, of FIG. 4. The cross-sectional shape of the pockets in FIG. 5 is, roughly, oval or elliptical.

Each tie board 14 measures about four and one quarter inches wide and about fourteen and one half inches long. Generally, the size of a tie board is about up to three quarter inch wider and up to one half inch longer than what is currently understood to be the size of a man's regular size neck tie, while folded in quarters. A man's regular size neck tie being sold in the current time period is understood to be about fifty-six inches long and about four inches wide. As to the weight and thickness of the tie board, it is preferably as light weight as possible, e.g. from one half to one and a half ounces in weight, and as thin as possible to maintain appropriate rigidity suitable for conveniently folding a tie about it and for inserting and withdrawing it from a pocket. The thickness of the tie board of the preferred embodiment disclosed is about three eighth inch.

A man's neck tie, folded in quarters on a tie board 14, fits into the storage pocket of the described size and is capable of being conveniently and comfortably inserted and withdrawn from the pocket.

Each of the plurality of tongues 4*a* and *b* formed out of the left and right edges of the center sheet is slightly less than 5 inches wide and extends approximately 1 inch out from the left or right mouths of a storage pocket. The tongues are the portions of the center sheet that extend about one inch beyond the mouth of the pockets and are generally an arc of less than 180 degrees about 5 inches wide at the base. Alternatively, the tongues can be generally rectangular in shape with rounded corners. The tongues improve the process of inserting and retrieving a tie board (with a folded tie) into and out of a pocket. The tongues are intended to be grasped by one hand while the other inserts or retrieves a tie board and is especially helpful with the preferred embodiment wherein pockets are located on both the front and back of the tie storage system.

Figure 4:
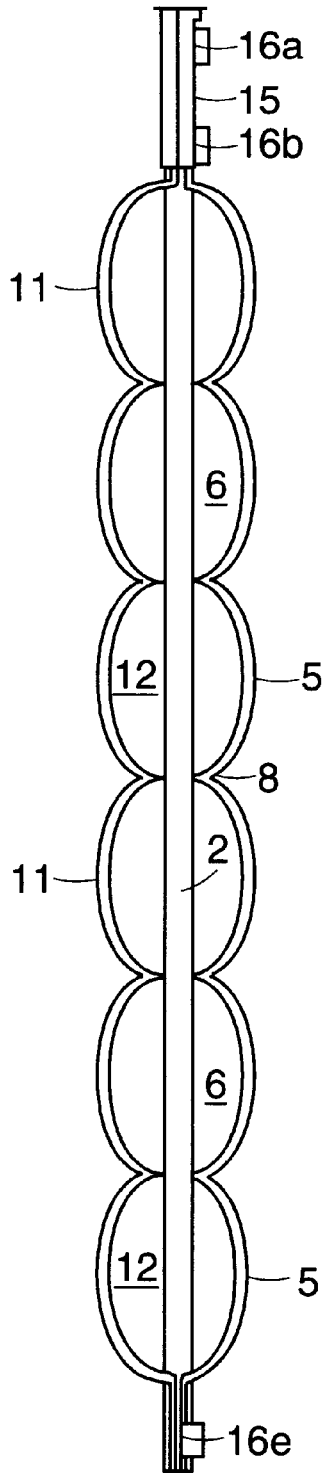
Figure 5:
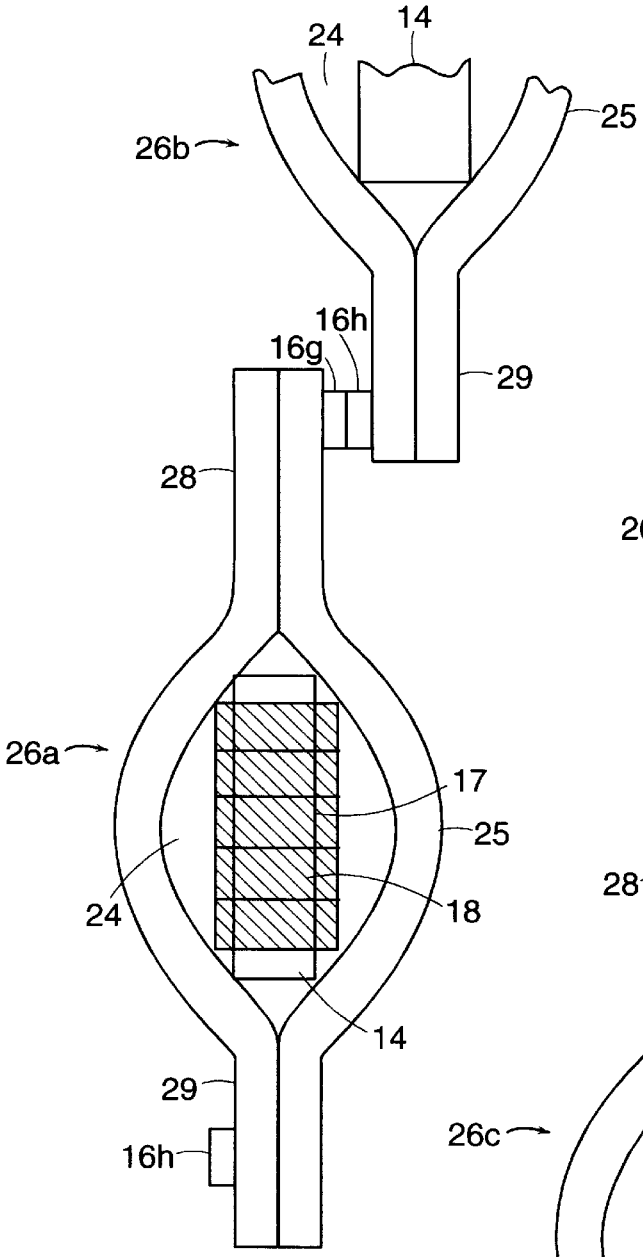
Figure 7:
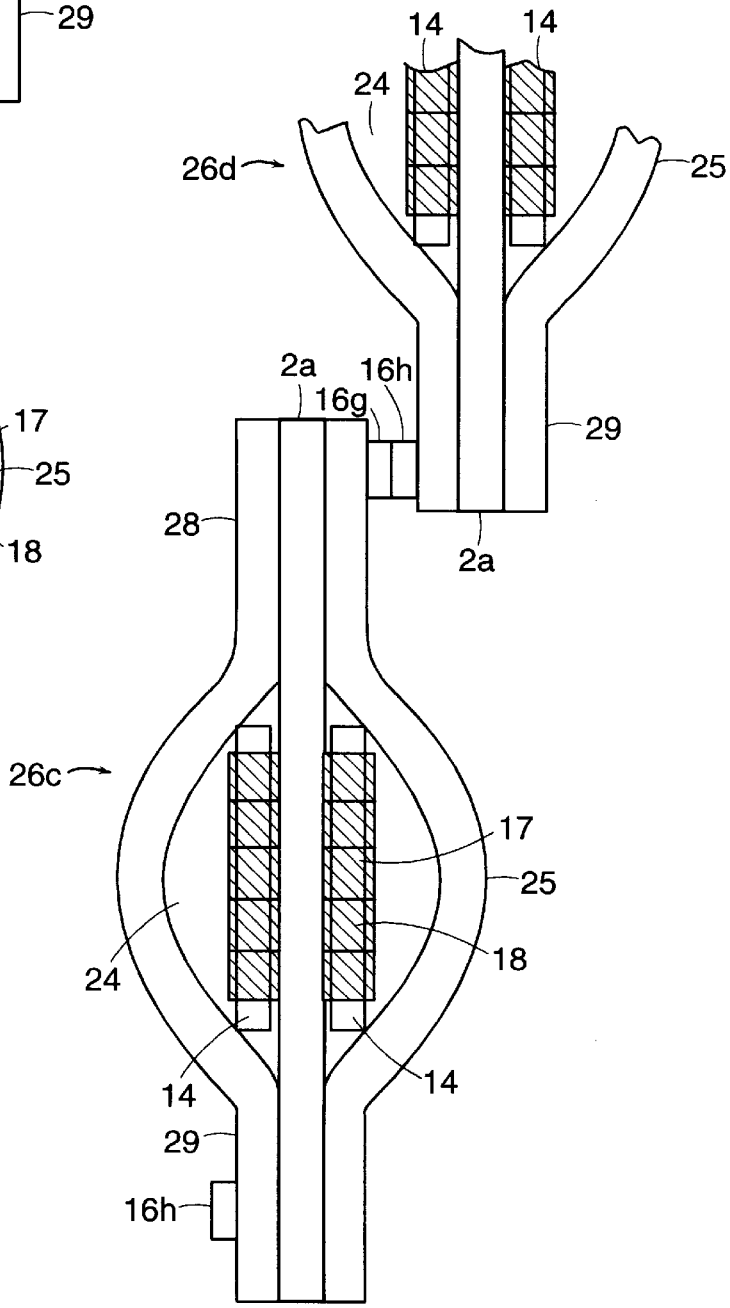

Turning now to FIG. 4, the front and rear storage pockets 6 and 12, respectively, are shown with an oval, roughly, cross-sectional shape, keeping in mind that the shape varies because the sheets 5 and 11 are pliant and generally assume different shapes during handling and usage. One function of center sheet 2, among others, is to act as a divider between the front and rear storage pockets.

Although not presently a preferred embodiment, the front plurality and/or back plurality of storage pockets may be opened at one end only. Also, in another embodiment, the front and back sheets 5 and 11 may be made from one contiguous sheet of pliant material with or without the use of a center sheet 2. In an embodiment without a center sheet, the storage system includes a single ladder or chain of storage pockets similar to that of FIG. 5. However, two chains of pockets are readily formed from the foregoing single pocket embodiments by, for example, inserting dividers into each of the single storage pockets.

The cross-section of hanger portion 15 shown in FIG. 4 shows the sandwich formed with sheets 2, 5 and 11. The center sheet extends about one inch into the hanger portion. Likewise, the cross-section of the sandwich formed with the same three sheets at the bottom one inch portion of the storage system is shown. This bottom portion has two Velcro fasteners 16*e* and *f* (only 16*e* is shown) coupled to it that may be used when system 1 is folded or rolled into a cylindrical shape, generally. In the folded or rolled condition, the fasteners 16*e* and *f* are capable of mating with fasteners 16*b* and *d*, for example, on the hanger portion to maintain the folded or cylindrical shape. The two fasteners 16*e* and *f* are also capable of being used to couple to fasteners of a separate tie storage pocket in a manner akin to that illustrated in FIG. 5.

Another embodiment of the present tie storage system is shown in FIG. 5 which depicts just one and one half, horizontal, parallel, storage pockets as representative of a plurality of such pockets. In this embodiment, one or more tie storage pockets 24 comprise the storage system. Tie storage pocket 24 is fabricated from two, light weight transparent sheets 25 and 26 of pliant material coupled together at the top and bottom regions 28 and 29 by thread stitching, for example. The oval or elliptical cross-sectional space between the two sheets thereby defines a tie storage pocket with openings at left and right ends for receiving a tie board 14 with or without a neck tie 17 folded about one end. The dimensions of the pockets are similar to those of the preferred embodiment and the pockets are capable of assuming a shape for accommodating a tie board of the size of board 14.

The multi-pocket, tie storage system of FIG. 5 includes the specific, tie storage pockets 24*a* and *b*, chained together by male and female Velcro fasteners 16*g* and *h* permanently coupled, respectively, to the top and bottom regions 28 and 29 of pockets 24*a* and *b*. Other fasteners such as snaps, buttons and zippers, for example, may be used in place of the Velcro fasteners. To repeat, pocket 24*a* has a male, for example, Velcro fastener 16*g* coupled to its top region 28 which mates with a female Velcro fastener 16*h* coupled to its bottom region 29. The reader should understand that a male Velcro fastener is permanently coupled to the top region 28 of pocket 24*b* and a female Velcro fastener is permanently coupled to the bottom region 29 of pocket 24*a*, neither of which are shown in FIG. 5 to simplify, and thereby clarify, the description.

Figure 6A:
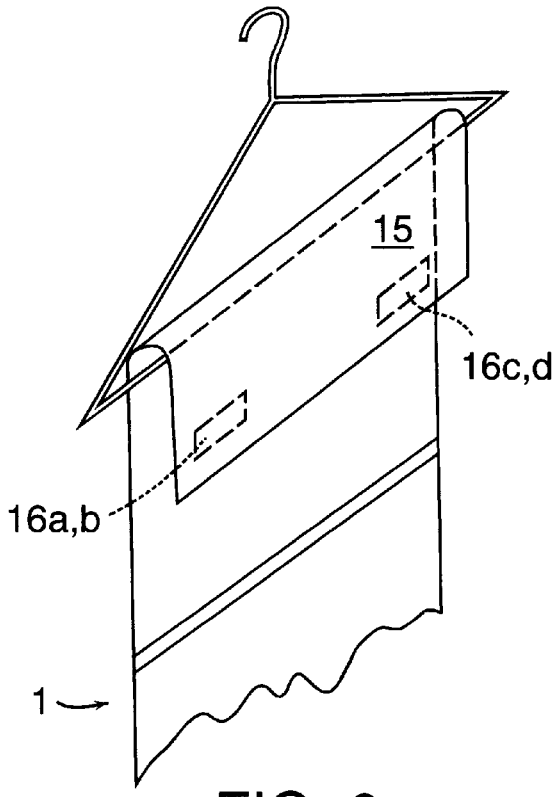

FIGS. 6*a* and *b* illustrate two methods for hanging the various embodiments of the present tie storage system from a closet clothes hanger. Alternatively, another embodiment of that disclosed herein is a storage system as described with a hanger permanently coupled to the plurality of tie storage pockets.

Referring to FIG. 6*a*, the hanger portion 15 of tie storage system 1 is shown folded over the cross member 33 of clothes hanger 32 and fastened together in a manner described above with Velcro fastener pairs 16*a* and *b* and 16*c* and *d*.

Figure 6B:
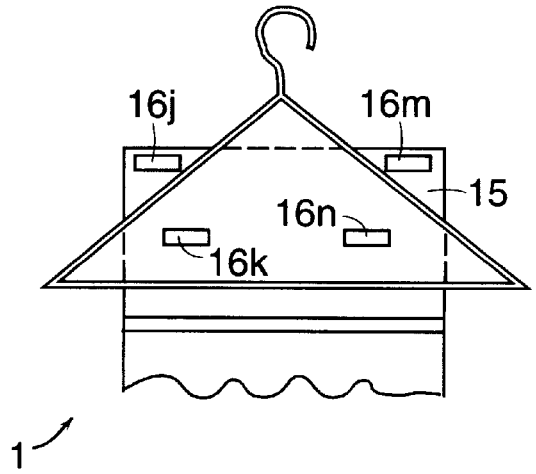

Referring to FIG. 6*b*, the hanger portion 15 of tie storage system 1 is shown with Velcro fastener pairs 16*j* and *k* and 16*m* and *n*. These fastener pairs are located generally at the upper left and right corners on the hanger portion 15 of system 1. The tips of the top right and left corners are folded over the left and right shoulder portions 34*a* and *b* of the hanger to permit the fastener pairs to engage or mate.

It is to be understood from the foregoing description taken alone and in conjunction with the drawings, numerous modifications may be made to the specific physical structures described above to create variations that are equivalent to the embodiments disclosed.

What is claimed is:

1. A neck tie storage system comprising in combination hanger means for hanging the storage system from a support member, a center sheet including a plurality of tongues located along its left and right edges and coupled to the fastener means for hanging the center sheet vertically when the fastener means is hung from a support member, front and rear sheets of pliable transparent material coupled, respectively, to the front and rear sides of the center sheet at a plurality of common seams for creating, in the spaces between the front and center sheets and between the rear and center sheets, in the regions between the seams, a plurality of parallel, front and rear storage pockets for storing neck ties generally horizontally when the hanger means is hung from a support member, each pocket including openings at left and right ends aligned with the left and right tongues for inserting a neck tie for storage through one end of a pocket and for withdrawing the neck tie from storage from the other end of the pocket and a plurality of carrier boards, each carrier board for inserting and removing a neck tie into and out of a pocket while folded about the leading edge of a carrier board toward the trailing edge, each carrier board remaining in a pocket during the storage of a neck tie in the pocket, the length of each carrier board from its leading to it trailing edge being substantially the length of a pocket and adequate to permit a neck tie, while folded in half, to be folded about a leading edge toward a trailing edge thereof without substantially extending beyond the trailing edge of the carrier board, wherein a neck tie may be stored in a pocket by folding the neck tie about the leading edge of the carrier board and inserting the leading edge of the carrier board into a pocket through the left opening and wherein a neck tie may be removed from a pocket by removing the carrier board from the pocket through the right opening of the pocket, or vice versa.

2. A neck tie storage system comprising in combination a plurality of neck tie storage pockets including a pliable material coupled together in a chain of parallel pockets for storing neck ties generally horizontally when hung from a support, each pocket having openings at left and right ends to accommodate the insertion or removal of neck ties from either end, at least one carrier board for inserting neck ties into the pockets by folding a neck tie about the leading edge of a carrier board toward the trailing edge and, while folded about the board, inserting the leading edge of the carrier board into a pocket through one of the openings and pushing the carrier board and neck tie into the pocket and a male or female fastener adjacent to the bottom edge of the storage system for coupling to one or more additional parallel pockets having a complementary male or female fastener adjacent an edge thereof for coupling to the storage system for expanding or contracting the number of pockets of the system by manually attaching or releasing said male and female fasteners.

* * * * *